US009077116B2

(12) United States Patent
Pamart

(10) Patent No.: US 9,077,116 B2
(45) Date of Patent: Jul. 7, 2015

(54) ELECTRICAL CONNECTOR FOR A SAFETY RESTRAINT SYSTEM HAVING A GROUND CONTACT

(75) Inventor: Olivier Pamart, Ecouen (FR)

(73) Assignee: Tyco Electronics France SAS, Pontoise (FR)

( * ) Notice: Subject to any disclaimer, the term of this patent is extended or adjusted under 35 U.S.C. 154(b) by 0 days.

(21) Appl. No.: 13/982,821

(22) PCT Filed: Jan. 24, 2012

(86) PCT No.: PCT/EP2012/051024

§ 371 (c)(1),
(2), (4) Date: Jul. 31, 2013

(87) PCT Pub. No.: WO2012/104171

PCT Pub. Date: Aug. 9, 2012

(65) Prior Publication Data

US 2013/0309884 A1 Nov. 21, 2013

(30) Foreign Application Priority Data

Feb. 1, 2011 (FR) ..... 11 00307

(51) Int. Cl.

| | |
|---|---|
| ***H01R 4/66*** | (2006.01) |
| ***H01R 13/648*** | (2006.01) |
| ***H01R 9/03*** | (2006.01) |
| ***H01R 13/6581*** | (2011.01) |
| ***H01R 13/6591*** | (2011.01) |
| *H01R 13/703* | (2006.01) |
| *H01R 103/00* | (2006.01) |

(52) U.S. Cl.

CPC ..... *H01R 13/648* (2013.01); *H01R 9/032* (2013.01); *H01R 13/6581* (2013.01); *H01R 13/6591* (2013.01); *H01R 13/7032* (2013.01); *H01R 2103/00* (2013.01); *H01R 2201/26* (2013.01)

(58) Field of Classification Search

CPC .. H01R 13/648; H01R 13/6591; H01R 9/032; H01R 2103/00; H01R 2201/26

USPC ..... 438/92, 101, 108, 685; 439/92, 101, 439/108, 685

See application file for complete search history.

(56) References Cited

U.S. PATENT DOCUMENTS 5,586,902 A * 12/1996 Hopf et al. ..... 439/352
6,000,970 A 12/1999 Wu (Continued)

OTHER PUBLICATIONS

International Search Report and Written Opinion issued by the European Patent Office, dated Mar. 7, 2012, for related International Application No. PCT/EP2012/051024; 10 pages.

*Primary Examiner* — Khiem Nguyen
(74) *Attorney, Agent, or Firm* — Faegre Baker Daniels LLP

(57) ABSTRACT

The present invention relates to an electrical connector for a plug-in connection, comprising a connector housing having a mating part defining a receiving section adapted for receiving a mating section of a counter-connector, at least two contact elements that are placed in the receiving section, and a ground contact assembly comprising a ground contact having a contacting portion adapted for being electrically connected with a grounding element of a retainer. For providing an electrical connector, which can be coupled with standard counter-connectors, the ground contact assembly of the electrical connector according to the present invention is arranged outside the receiving section with the contacting portion extending at least section-wise into the receiving section.

14 Claims, 6 Drawing Sheets

(56) References Cited

Figure 1:
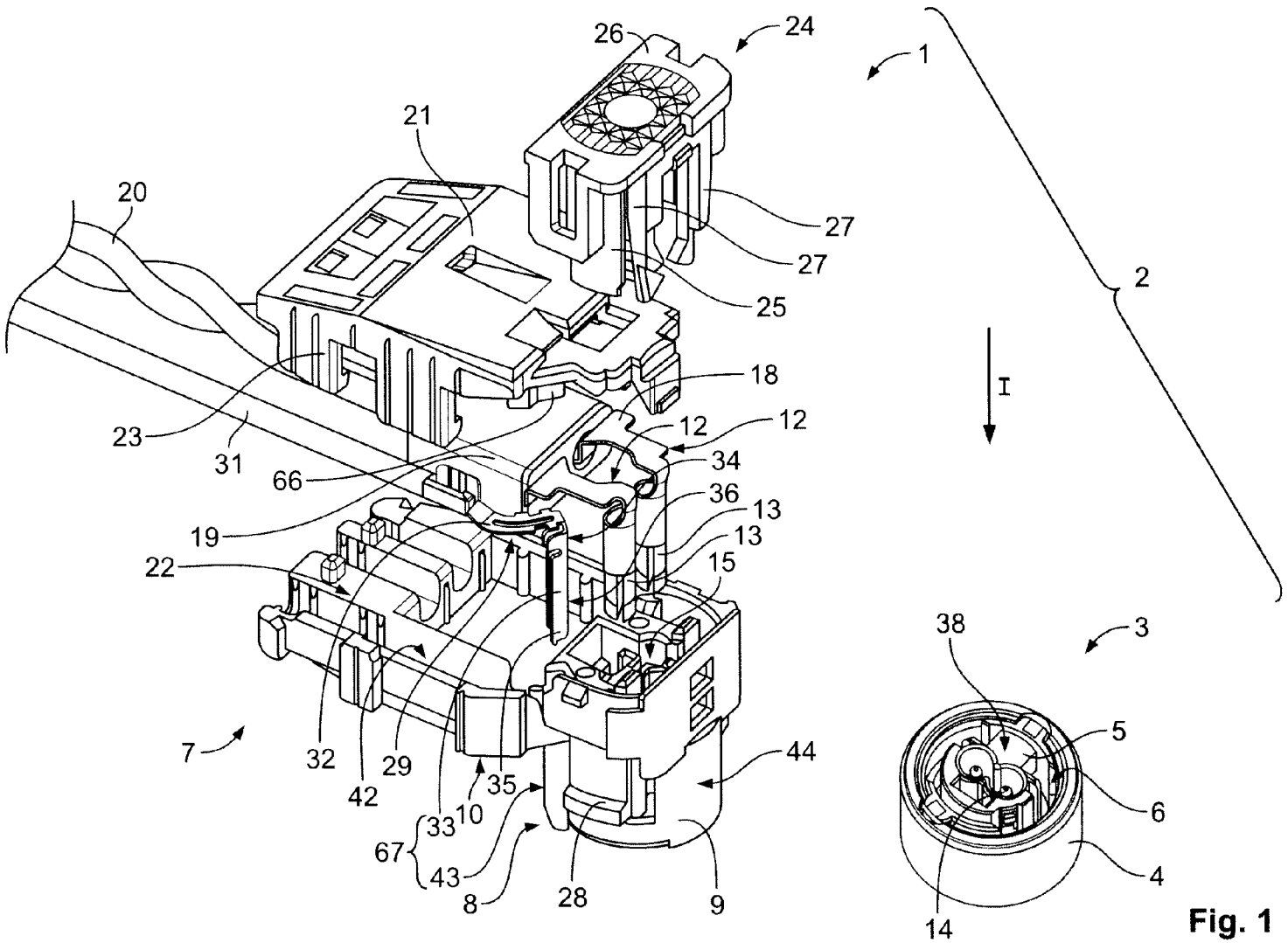

U.S. PATENT DOCUMENTS 6,077,126 A 6/2000 Peng
6,910,904 B2 * 6/2005 Herrick et al. ..... 439/271
2004/0248475 A1 12/2004 Seminara et al.

* cited by examiner

ELECTRICAL CONNECTOR FOR A SAFETY RESTRAINT SYSTEM HAVING A GROUND CONTACT

The present invention relates to an electrical connector for a plug-in connection, in particular a squib connector for a safety restraint system, comprising a connector housing having a mating part defining a receiving section adapted for receiving a mating section of a counter-connector, at least two contact elements that are placed in the receiving section, and a ground contact assembly comprising a ground contact having a contacting portion adapted for being electrically connected with a grounding element of the counter-connector as well as an attachment element for mounting the ground contact.

Motor vehicles nowadays have various safety restraint systems, such as seat belt pre-tensioner or airbags, which serve to cushion or limit the impact on the passenger in case of an accident. Sensors in the vehicle can detect the occurrence of an accident and send a triggering signal via a cable to the safety restraint system. An explosive device, known as a squib, then inflates the airbag or tightens the belt. The cables running from the electric control unit of the sensor are terminated on an electrical connector, generally referred to as a squib connector, that can be connected with the squib holder or socket of the counter-connector by inserting the mating or plug part of the connector, in an insertion direction into the squib socket.

To improve the connection between the squib and the electrical plug connector, retainer inserts were developed which are adapted to fit into a receptacle or pocket of a standardized squib and which facilitate and secure the connection between the squib and the electrical connector. The retainer generally provides fastening means for mechanically securing the fully-mated electrical connector within the counter-connector. These retainer inserts are commonly further provided with a shorting device, which short-circuits the contact pins on the side of the squib, before the plug connector is electrically connected to the squib counter-connector. The shorting device of the retainer can usually be opened for activating the squib plug-in connection only when the electrical connector and the counter-connector are in the fully-mated state, in which the connector and the counter-connector are electrically and mechanically connected. The activator for releasing the shorting device and thus activating the squib connection is usually designed as a connection position assurance that can be moved relative to the connector housing for opening the short-circuit only in the fully-mated state of the plug-in connection.

Electrical connectors may be provided with ground terminals having ground contact. The ground contacts may be electrically contacted with a corresponding grounding element of the retainer. Electrical contact between the ground contact of the connector and the grounding element of the retainer avoids any electrostatic discharge inside the safety restraint system which could also accidentally ignite the pyrotechnic device.

In the known electrical squib connectors for a safety restraint system, the whole ground contact is arranged inside the receiving section of the mating part. For arranging and mounting the ground contact, arrangement or fastening means are provided inside the receiving section of the known connectors. However, providing the attachment means for the ground contact inside the receiving section is problematic because such attachment means may hinder the receipt of the mating section. Further, the mating section of the counter-connector could damage the arrangement means and loosen the ground contact.

Hence, a counter-connector with a specifically designed mating section is required for use with an electrical connector having the ground contact arranged and fastened inside the receiving section.

The problem of the present invention is thus the provision of an improved electrical connector, such as a squib connector for a safety restraint system that is provided with a ground contact, and can be coupled with standardized counter-connectors. The present invention solves the above technical problem in that the ground contact assembly is arranged outside the receiving section with the contacting portion at least section-wise extending into the receiving section.

Contrary to the connectors known from the prior art, the ground contact assembly, in particular its ground contact and the attachment element, is arranged outside the receiving section and does not extend into the receiving section. According the present invention, only the contacting portion, i.e. that part of the ground contact that is to be brought into electrical contact with the grounding element of the retainer, extends into the receiving section without the need for providing any attachment or fastening means inside the receiving section. This surprising and simple solution renders attachment means inside the receiving section redundant and allows for the arrangement of the ground contact without the need to modify the coding face of the receiving section of the electrical connector.

Thus, with the electrical connector of the present invention, standardized retainers can be used. Further, damaging the attachment element is prevented, because the attachment means are arranged outside the receiving section.

The solution according to the present invention may be combined in any way with any one of the following advantageous embodiments of the present invention respectively and further improved.

According to an embodiment, the contacting portion may be substantially aligned with the inner wall of the mating part that encompasses the receiving section. Substantially aligned means that the contacting portion is flush with the inner wall and protrudes only to a minimum degree into the receiving section that is required for contacting the grounding element. This alignment allows for a compact design of the connector with a generally unchanged coding face.

According to an embodiment, the connector housing may comprise the attachment element for mounting the ground contact. Preferably, the attachment element is provided at the mating part, in particular, at the outer surface of the mating part that faces away from the receiving section and substantially faces perpendicular to the insertion direction. Thereby, small and compact ground contacts may be used that can be mounted by the attachment element in close proximity to the receiving section. The attachment element may additionally serve as a protection device, shielding the ground element against the outside.

According to a further embodiment, the attachment element may comprise a ground contact housing for shielding the ground contact against the outside. A ground contact housing may receive the ground contact for attaching and mounting the ground contact with the connector. At the same time, the housing covers and protects the ground contact. An easy way of producing an attachment means such as one formed as a ground contact housing is to integrally form the ground contact housing with the connector housing. Forming the attachment means integrally with the connector housing, e.g. at the outer surface of the mating part, makes the production of further elements for attaching and shielding the ground contact unnecessary and furthermore allows for a compact design of an electrical connector.

One way of integrally forming the ground contact housing with the connector housing is injection molding.

According to a further embodiment, the ground contact is mounted with positive locking at the attachment element. Alternatively, or additionally, the ground contact may be mounted with a non-positive or friction lock. In one embodiment, the ground contact may be positively fitted inside the ground contact housing.

According to a further embodiment of the present invention, a cover may be provided for securing the ground contact against removal from the attachment element. In one embodiment, the cover may be the regular cover of the electrical connector that is adapted for closing open parts of the connector housing, e.g. the open part for inserting the contact terminals, the cable ends and/or a grounding terminal that is provided with a ground contact.

According to a further embodiment, the mating part of the connector housing may comprise a window forming a passage for the contacting portion inside the receiving section. Such a window, e.g. a through-opening in the boundary, such as the mating body or wall of the mating or plug part, can be easily designed and is simple to construct, yet securely allows for an efficient extension of the contacting portion of the ground contact into the receiving section. Modifications inside of the receiving section are not necessary.

According to a further embodiment, the window may be designed as a slot. This allows for the extension of an elongated contacting portion into the receiving section through the slot-shape window. For matching the slot with a ground contact whose contacting portion runs substantially parallel to the insertion direction of the electrical connector, the slot may form a window that runs substantially parallel to the insertion direction.

In a further embodiment of the present invention, the window may form a passageway from the ground contact housing to the receiving section. A direct opening extending from the ground contact housing into the receiving section of the mating part allows simple designed ground contacts to be used and contributes to a compact design of the connector housing. In one embodiment, the ground contact housing substantially extends in the insertion direction. The housing may be provided with an insertion opening for placing the ground contact inside the housing. The insertion opening preferably opens in the direction opposite to the insertion direction.

In a further embodiment, the ground contact may be positively fitted and/or non-positively fitted within the ground contact housing, having a window, such as a slot-like window, forming a passage from the ground contact housing into the receiving section. This assures that the ground contact is kept in the mounted place.

According to a further embodiment, the ground contact may be substantially arranged along the insertion direction. Since the grounding element of the counter-connector generally extends in the insertion direction as well, an alignment of the ground contact with the grounding element of the retainer is thus achieved which allows for an electrical connection at an early stage of plugging the electrical connector into the counter-connector. Further, a large contacting area between the contacting portion of the ground contact and the grounding element of the retainer is provided by such an alignment.

According to a further embodiment of the present invention, at least one positioning element for securing the ground contact against displacement out of a pre-determined mounted position may be provided. Such positioning element assures a correct mounting of the ground contact at the attachment means and at the same time anchors the ground contact in the pre-determined mounted position. A shifting or movement of the ground contact in a fully-assembled electrical connector is thus avoided and the positioning element assures that the ground contact remains in the pre-determined mounted position with its contacting portion extending into the receiving section.

The positioning element is preferably provided at the ground contact. In one embodiment, the positioning element may be arranged at the distal end of the ground contact. The distal end of the ground contact is the free end opposite to the proximal end or cable end of the ground contact that is facing towards the termination element of the ground terminal that is electrically connected with the ground wire. Arranging the positioning element at the distal end assures that in particular the part of the ground contact that is easiest to displace and/or deform, namely the free tip, is held in its pre-determined position.

According to a further embodiment of the present invention, the ground contact may comprise stiffening regions providing an improved deformation resistance, such as resistance to bending.

The stiffening regions provide a more robust design of the ground contact, enabling that the ground contact does not easily deform and thereby ensure that the contacting portion of the ground contact remains in the receiving section and is not accidentally deformed or moved out of the receiving section. The ground contact may be provided with bulges, beads or a specific cross-section, forming the stiffening region. Alternatively, additional reinforcement members for stiffening the ground contact may be provided.

In one embodiment, the ground contact may have at least section-wise a U-shaped cross-section. A U-shaped cross-section stiffens the ground contact and improves its resistance to bending. At the same time, the bended section or curvature of the U-shaped cross-section can be used as the contacting portion extending into the receiving section, which allows for an improved electrical contact between the contacting portion and the grounding element of the retainer. The grounding element of the retainer is generally flat. Coupling a flat grounding element with a flat ground contact may be problematic and requires a precise alignment of the two planes. Providing a bended, curved contacting portion however improves the electrical grounding contact, because a bended or U-shaped contact may apply a higher contacting force acting and pressing against a flat grounding element and does not require such a precise alignment as a flat-to-flat contact does. Preferably, the bended section or curvature is aligned with the inner wall of the mating part facing inside the receiving section, with only the area at the crest or summit of the curvature reaching inside the receiving section.

The invention is described hereafter by means of examples referring the exemplary embodiments with reference to the drawings. The various features of the described embodiments can be combined or omitted independently of one another, as already described above.

Figure 3:
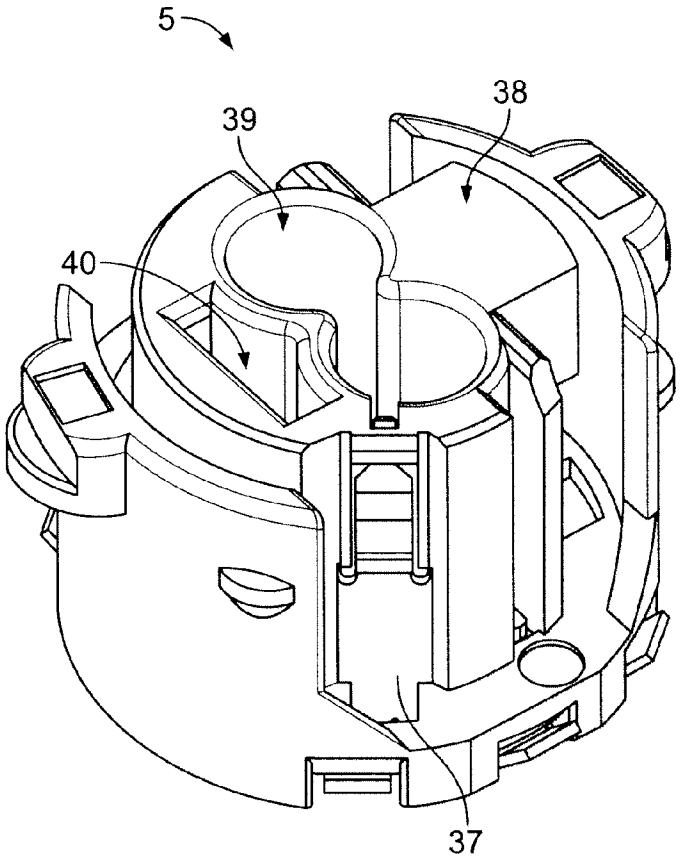
Figure 2:
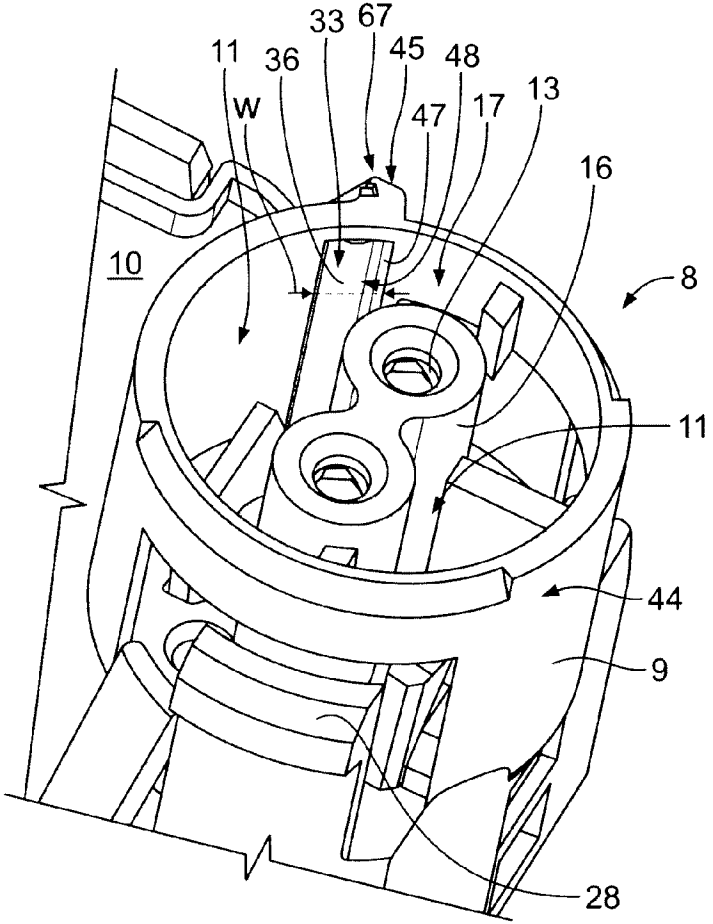
Figure 5:
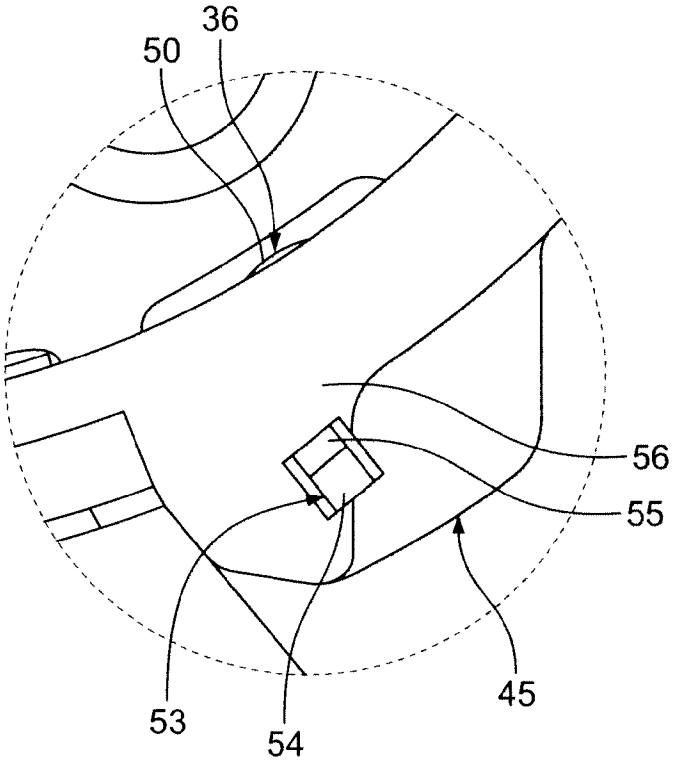
Figure 4:
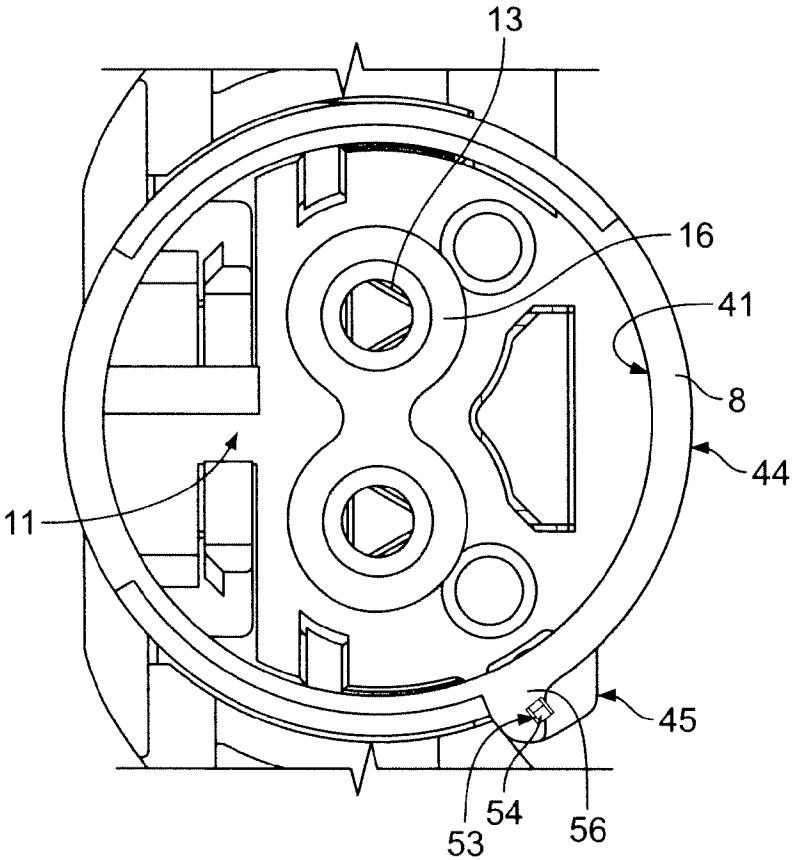
Figure 7:
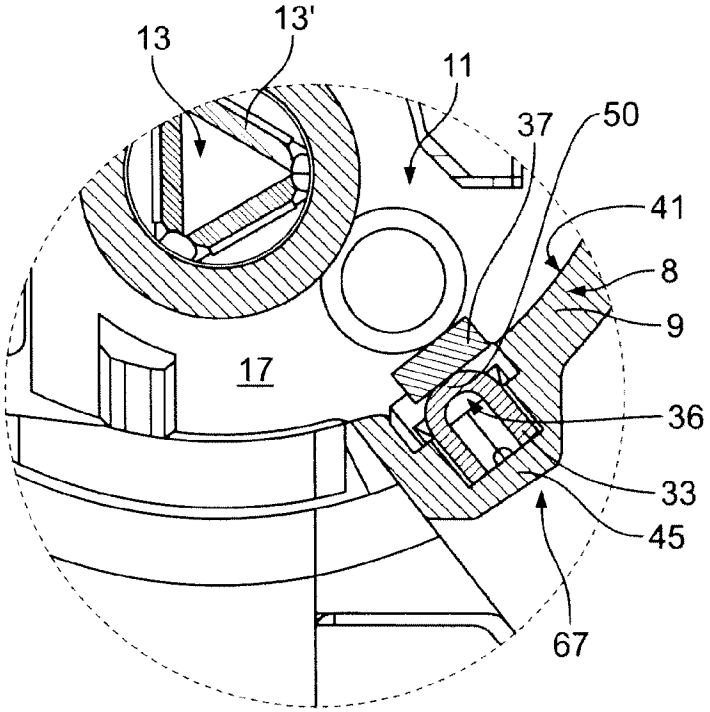
Figure 6:
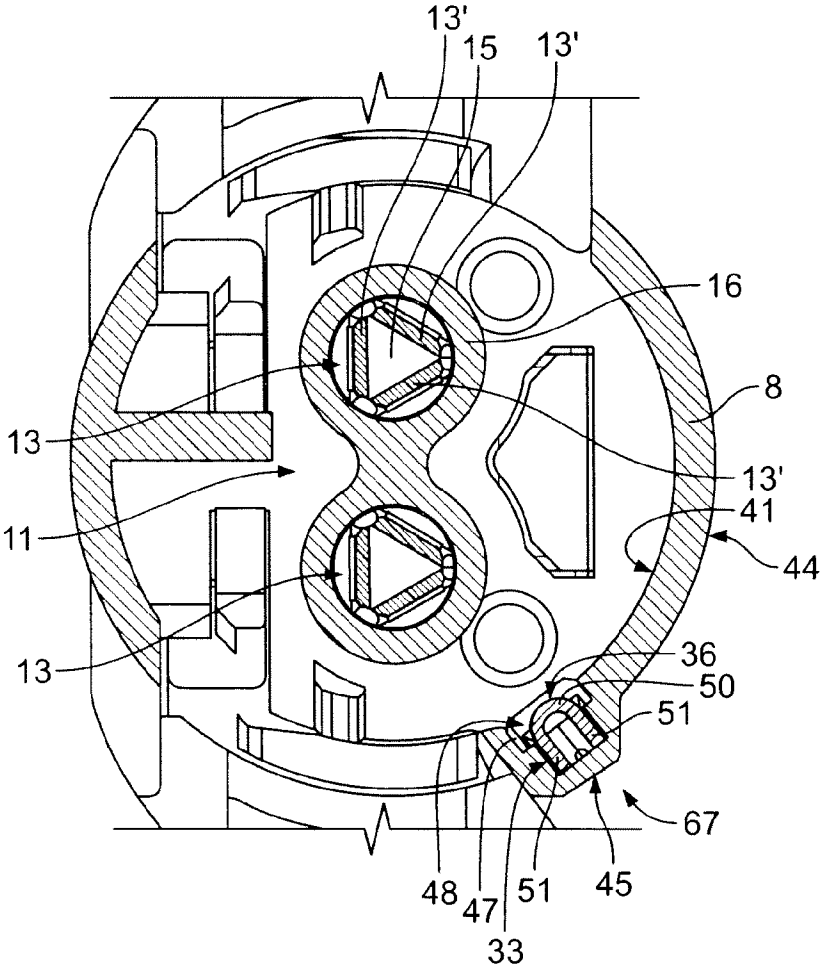
Figure 9:
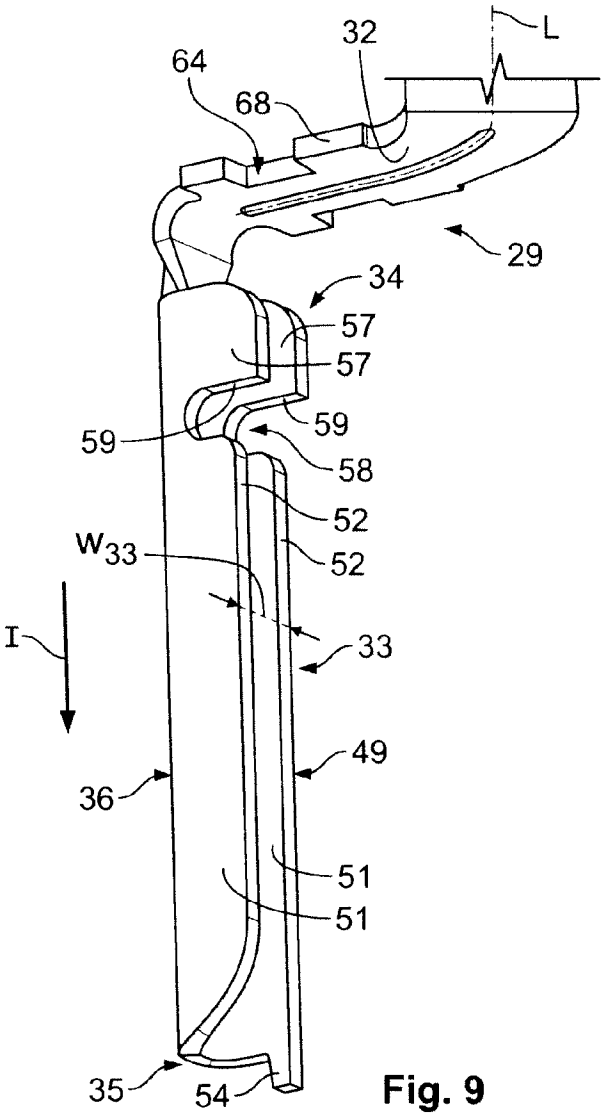
Figure 8:
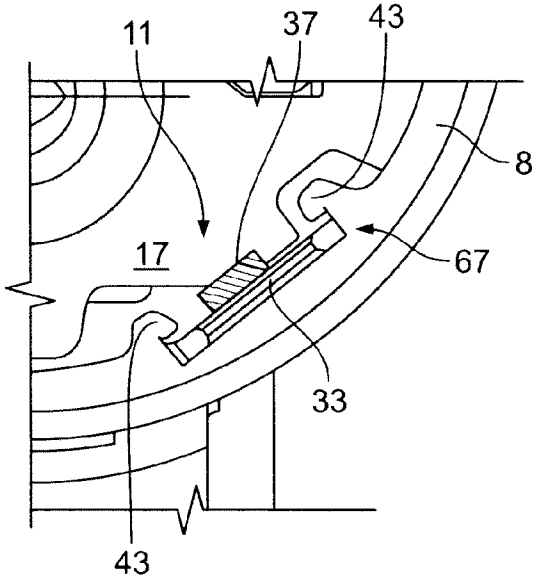
Fig. 8 (Prior Art)
Figure 10:
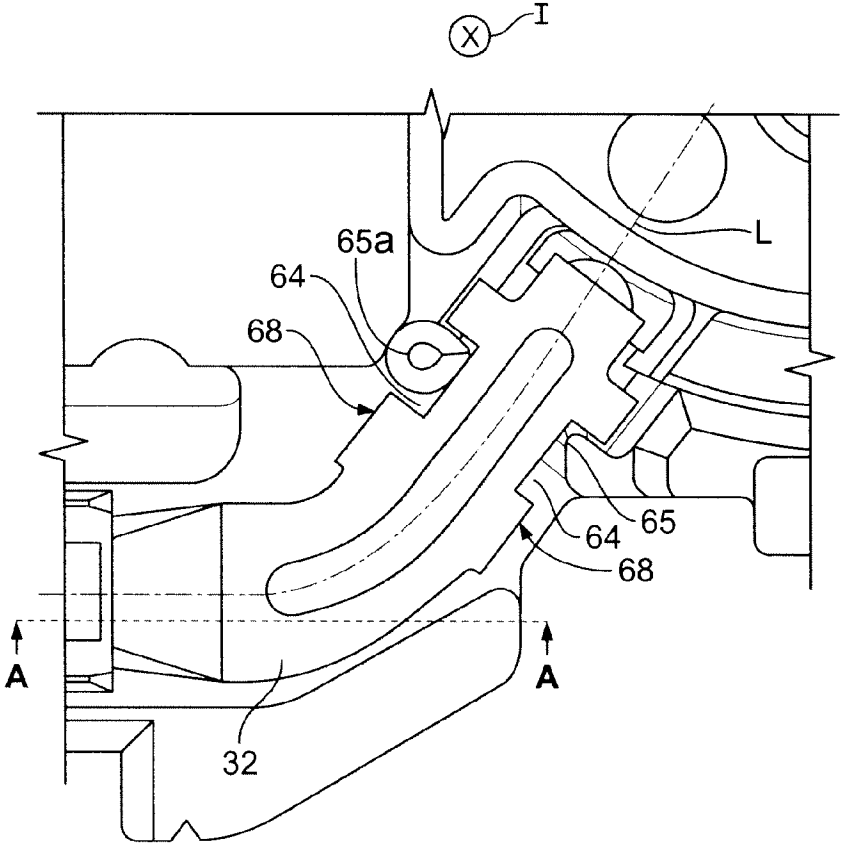

In the drawings:

FIG. 1: shows a schematic perspective representation of a plug-in connection with an explosive representation of an exemplary electrical connector according to the present invention together with a partial representation of the counter-connector having a retainer;

FIG. 2: shows a schematic perspective representation of the bottom of the assembled electrical connector of FIG. 1 in particular showing the mating part;

FIG. 3: is a detailed representation of the retainer of the counter-connector shown in FIG. 1;

FIG. 4: is a detailed representation of the mating part of the electrical connector of FIG. 1, shown against the insertion direction;

FIG. 5: is an enlarged detailed representation of FIG. 4 showing the part with the contacting portion of the ground contact;

FIG. 6: is a cross-sectional representation of the mating part of the connector according to FIG. 4;

FIG. 7: is an enlarged detailed representation of FIG. 6 showing the part with the attached ground contact, and indicating the contact between the ground contact of the connector and the ground terminal of the counter-connector;

FIG. 8: shows an extract of a bottom view of a squib connector of the prior art that is provided with a ground contact fastened in the receiving section of the connector, and indicating the contact between the ground contact of the connector and the ground terminal of the counter-connector;

FIG. 9: shows a partial schematic perspective representation of the ground terminal comprising the contact according to the shown embodiment;

FIG. 10: is a top view in the insertion direction onto the ground terminal part of FIG. 9 assembled to the connector housing; and FIG. 11: is a cross-sectional representation of the assembled ground terminal along intersectional line A-A In the following, the electrical connector 1 according to the present invention is explained with reference to the embodiment thereof shown in the Figures.

FIG. 1 shows an explosive representation of the electrical connector 1 that forms a plug-in connection 2, that may also be referred to as a squib connector assembly, together with a counter-connector 3. In FIG. 1, only the socket 4 of the counter-connector 3 with the retainer 5 mounted inside the pocket 6 provided by the socket 4 is displayed. The connector 1 may be plugged into the counter-connector 3 in the insertion direction I.

The electrical connector 1 comprises a connector housing 7 having a mating part 8 that is shown in detail in FIGS. 2, 4 and 6. The mating part 8 is designed as a substantially annular mating housing or body 9. The contact housing 9 protrudes from the bottom 10 of the connector housing 7 in the insertion direction I. The receiving section 11 and all components arranged therein make up the coding face 17 of the connector 1. The outer surface 44 of the contact housing 9 faces substantially perpendicular to the insertion direction I. The mating part 8 defines a receiving section 11 that is adapted for receiving at least the mating section 36 of the retainer 5 of the counter-connector 3.

The electrical connector 1 further comprises two contact terminals 12, each comprising a contact element 13. The contact elements 13 in the shown embodiment are designed as contact clamps 13 having three clamping arms 13' that are arranged substantially in the insertion direction I and parallel with each other forming, in the cross-section, a triangle for receiving a contact pin 14 of the counter-connector 3. The contact elements 13 can be inserted in the insertion direction I into contact apertures 15 of the mating part 8. The contact apertures 15 run substantially in the insertion direction I and the contact elements 13 may be arranged such that at least the clamping arms 13' are placed in the receiving section 11 of the mating part 8. The contact aperture body 16 that defines and envelopes the contact apertures 15 is formed in the receiving section 11 and contributes to the coding face 17 of the electrical connector 1, can be seen e.g. in FIG. 2, 4 or 6.

The contact clamping arms 13' are provided at the free, distal end of the contact elements 13 facing in the insertion direction. At the opposite, proximal end, the contact elements 13 are connected with a transition element 18 of the contact terminal 12. The transition elements 12 run substantially perpendicular to the contact elements 13 and are terminated with a cable 20 at the cable end that is opposite to a part of the transition section connected with the contact elements 13. The free or cable end of the transition section 18 is placed inside a ferrite filter 19 isolating the two contact terminals 12 from each other. The cables 20, which in the shown embodiment are provided as a twisted cable pair 20, are terminated to the contact terminal 12 in that part of the transition section 18 that is placed inside the ferrite filter 19.

The electrical connector 1 further comprises a cover 21 to be placed on the top surface 22 of the connector housing 7, facing against the insertion direction I. The cover 21 closes the housing 7 and conceals the parts of the connector 1 that are placed inside the connector housing 7. The cover 21 is provided with latches 23 for easily fixing the cover 21 to the connector housing 7.

The electrical connector 1 in the shown embodiment is designed as a squib connector that is provided with an actuator 24. The actuator 24 is designed as a contact positioning assurance member. The actuator 24 comprises a contact opening part 25 for releasing a short circuit element (not shown) deactivating the plug-in connection 2. When the actuator 24 is moved in the insertion direction I from its pre-mounted state, in which the actuating surface 26 is placed against the insertion direction I at a distance above the cover 21, into the fully-mated and actuated state, in which the actuating surface 26 is principally aligned with and rests in the surface of the cover 21, the short-circuit is released by the contact opening part 25. The actuator 24 is further provided with locking elements 27. The locking elements 27 are adapted for securing a locking latch 28, mechanically fixing the electrical connector 1 in the mated state in the counter-connector 3. The locking latch 28 is provided at the mating part 8.

The electrical connector 1 of the shown embodiment is further provided with a ground terminal 29. The ground terminal 29 that is shown in more detail in FIG. 9 is provided with a clamping part 30 for being contacted to a ground wire 31. The clamping part 30 is arranged at the cable end of an anchoring plate 32 that runs substantially in the plane defined by the bottom 10 or the top surface 22 of the connector housing 7, that is the plane perpendicular to the insertion direction I. At the end opposite to the clamping part 30, the anchoring plate 32 is provided with a ground contact 33. The ground contact 33 runs substantially perpendicular to the anchoring plate 32 and substantially extends in the insertion direction I from its proximal end 34 that is connected with the anchoring plate 32 to its distal end or tip 35 that faces in the insertion direction I. The ground contact 33 is provided with a contacting portion 36 that is adapted for being electrically connected with a grounding element 37 of the retainer.

When connecting the electrical plug-in connector 1 in the insertion direction I with the counter-connector 3, the mating part 8 is received in the socket 4 of the counter-connector 3. The receiving section 11 of the mating part 8 in turn receives the mating section 38 of the retainer 5. This mating section 38 comprises contact openings 39, in which the contact pins 14 of the counter-connector 3 are placed. The contact openings 39 are designed for receiving the contact aperture body 16 that are housing the contact elements 13. During this plugging, the contact elements 13 are electrically connected with the contact pins 14. The mating section 39 of the retainer 5 also comprises an aperture 40 for receiving the contact opening part 25 of the actuator 24.

When connecting the electrical connector 1 in the insertion direction I with the counter-connector 3, furthermore the contacting portion 36 of the ground contact 33 is electrically connected with the grounding element 37 of the retainer 5. This electrical connection between the contacting portion 36 of the ground contact 33 and the grounding element 37 of the counter-connector 3 avoids electrostatic discharges inside the plug-in connection 2 that may accidentally trigger the safety restraint system for which the plug-in connection is used.

The ground contact 33 of the electrical connector 1 according to the shown embodiment of the present invention is arranged and mounted outside the receiving section 11, which is defined by the mating part 8. The receiving section 11 corresponds principally to the circular section surrounded by the inner wall 41 of the circular mating housing or body 9. The ground contact 33 is arranged outside the receiving section 11 such that the contacting portion 36 thereof extends into the receiving section 11, as can be seen for example in FIGS. 2, 4 and 5.

The connector housing 7 is provided with a grounding channel 42 for receiving the termination end of the ground wire 31, the clamping part 30 as well as most of the anchoring plate 32.

The connector 1 furthermore comprises an attachment element 43 for mounting the ground contact. The attachment element 43 and the ground contact 33 constitute the grounding assembly 67 of the connector 1.

The attachment element 43 of the grounding assembly 67 is arranged at the outer surface 44 of the mating part 8 and thus outside the receiving section 11 as well as.

In the shown embodiment, the attachment element 43 comprises a ground contact housing 45. The ground contact housing 45 principally extends in the insertion direction I along the whole length of the mating part 8. The ground contact housing 45 has an opening 46 facing against the insertion direction I for inserting the ground contact 33 with its distal end 35 first along the insertion direction I through the opening 46 into the ground contact housing 45. The ground contact housing 45 serves as an attachment means 43 for mounting the ground contact 33. At the same time, the ground contact housing 45 covers the ground contact 33 and protects the ground contact 33 against the outside. The ground contact housing 45 of the shown embodiment is formed integrally with the connector housing, here, the mating part 8, and may be produced, for example by injection molding.

In the shown embodiment of the electrical connector 1 according to the present invention, the mating part 8 comprises a window 47. This window forms a passage 48 from the outside of the receiving section 11 inside the receiving section 11. In the shown embodiment, the window 47 is designed as a through-hole in the body 9 of the mating part 8. The window 47 extends from the inside of the ground contact housing 45 into the receiving section 11 so that the window 47 forms a passageway for the contacting portion 36 of the contact element 33 from the attachment means 43, namely the ground contact housing 45, to the receiving section 11, where the contacting portion 36 is at least section-wise arranged capable of being brought into electrical contact with the grounding elements 37 of the retainer. In the shown embodiment, the window 47 is designed as a slot that runs substantially parallel to the insertion direction I inside the ground contact housing 45.

In the following, the mating part 8 defining the receiving section 11 of the electrical connector 1, the anchoring plate 32, as well as the ground terminal 29, comprising the ground contact 33, are described in more detail.

The ground contact 33 has an elongated shape that runs substantially in the insertion direction I, when mounted to the attachment means 43. This can be seen, for example, in FIG. 11 showing the arrangement of the ground element 33 along the insertion direction I within the ground contact housing 45 provided at the outer surface or wall 44 of the mating part 8.

The ground contact 33 is provided with stiffening regions 49 improving the resistance of the ground contact 33 to bending. In the shown embodiment, the stiffening regions 49 are provided by a U-shaped cross-section of the ground contact 33, as can be seen for example in FIGS. 6 and 9. The stiffened regions 49 of the ground contact 33 avoid a plastic deformation of the ground contact 33 and shall thereby prevent that the part of the contacting portion 36 that extends into the receiving section 11 is moved out of the receiving section 11. In the shown embodiment, the curvature 50 or bended portion of the cross-sectionally U-shaped ground contact 33 constitutes the contacting portion 36 of the ground contact 33.

FIGS. 7 and 8 show a schematic cross-sectional representation displaying how the ground contact 33 is contacted to the grounding element 37 of the counter-connector 3, with respect to the connector 1 according to the present invention in FIG. 7 and according to a connector of the prior art in FIG. 8.

As can be seen in FIG. 7, the curvature 50 of the U-shaped ground contact 33 is electrically contacted with the flat grounding element 37 of the retainer 5 of the counter-connector 3. Contrary thereto, a flat ground contact 33 is used in the prior art shown in FIG. 8. The U-shaped design of the ground contact 33 according to the shown embodiment of the present invention facilitates and improves the electrical contact between the ground contact 33 of the connector 1 and the grounding element 37 of the counter-connector 3 because, by contacting the flat ground terminal 37 with the curvature 50 of the ground contact 33, a higher contact pressure can be applied, acting from the curvature 50 on to the flat grounding element 37. Moreover, a flat-to-flat connection, as in the prior art, requires a much more precise alignment of the ground contact 33 with the grounding element 37, whereas the curved contacting portion 26, as shown in FIG. 7, allows greater tolerance.

As can be further seen in FIG. 7, the contacting portion 36 is substantially aligned with the inner wall 41 of the mating part 8 that encompasses the receiving section 11. Generally, the whole curved contacting portion 36 is substantially flush with the inner wall 41 of the mating housing 9. Only the crest or summit of the contacting portion 36, at which the electrical contact is realised between the ground contact 33 and the grounding element 36 extends into the receiving section 11. The protrusion of the curvature 50 into the receiving section 11 is held to the lowest degree possible while at the same time assuring a safe electrical contact between the contacting portion and the grounding terminal 37.

Contrary thereto, as can be seen in FIG. 8, the grounding assembly 67 of the connector according to the prior art is generally arranged inside the receiving section 11, changing the coding face 17 thereof and making the corresponding adjustments for receiving in particular the attachment elements 43 necessary on the side of the counter-connector 3.

The two legs 51 of the U-shaped ground contact 33 are mounted with a positive lock at the attachment element 43. As can be seen in FIG. 6, the two legs 51 of the ground contact 33 principally rest against the two opposing inner walls of the ground contact housing 45 restricting the movement of the ground contact 33 in the direction perpendicular to the insertion direction I and perpendicular to the passage 48 of the window 47. The free sides 52, of the legs 51 rest against the inner wall of the ground contact housing 45 that is opposite to the window 47. The width $w_{47}$ of the window 47 may be smaller than the width $w_{33}$ of the ground contact 33. With such a configuration, the curved contacting portion 36 could be partially arranged inside the ground contact housing 45 abutting against the window 47 from the inside of the ground contact housing 45, with the crest or summit of the bended portion 50 extending into the receiving section 11. Thereby, the ground contact 33 is mounted in a positive lock against movement in the insertion direction I as well as perpendicular to the insertion direction I at the ground contact housing 45 at the attachment element 43.

Figure 11:
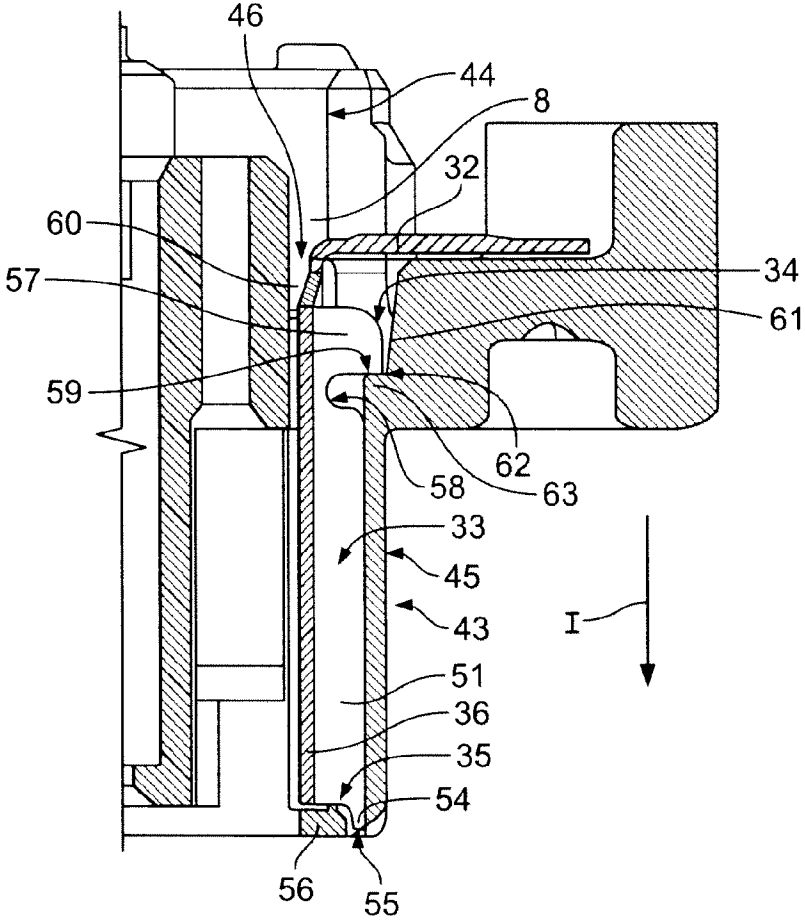

However, the width $w_{47}$ of the window 47 may even be wider than the width $w_{33}$ of the ground contact 33 if the ground contact is provided with a positioning element 53, as shown in FIGS. 10 and 11. A positioning element 53 of the shown embodiment is designed as a pin 54 arranged at the distal end 35 of the ground contact 33. The pin 54 principally protrudes in the insertion direction I from the distal end 35 of the ground contact 33. The pin 54 secures the ground contact 33 against displacement out of the pre-determined mounted position by engaging a recess 55 provided in the bottom 56 of the ground contact housing 45.

Upon placing the pin 54 at the distal end 35 of the ground contact 33 in the recess 55 provided at the bottom 56 of the ground contact housing 45, the ground contact 33 is secured against displacement perpendicular to the insertion direction I, when mounted in the ground contact housing 45. Thereby, it is assured that the contacting portion 36 of the ground contact 33 remains inside the receiving section 11 adapted for contacting the ground terminal 29 of the retainer 5.

The proximal end 34 of the ground contact 33 is provided with positioning shoulders 57. The positioning shoulders 57, further positioning elements 53, are formed from the legs 51 of the U-shaped ground contact 33. At the proximal end 34, the legs 51 are longer and extend further in the direction, at which the sides 51 at the base of the U-shaped contact element 33 face, than in the remainder of the ground contact 33. Furthermore, notches 58 are provided between the positioning shoulders 57 at the proximal end 34 and the remainder of the legs 51 of the ground contact 33, so that the resting faces 59 of the positioning shoulders 57 facing in the insertion direction I provide a supporting means for mounting the ground contact at the attachment element 43.

As can been seen in FIG. 11, the ground contact housing 43 is provided with an entrance section 60 facing against the insertion direction I and comprising the opening 46. The side wall 61 in the entrance section 60 facing away from receiving section 11 is sloped, narrowing towards the bottom 56 of the ground contact housing 45 which facilitates the insertion and the mounting of the ground contact 33 in the insertion direction I into the ground contact housing 45.

The bottom end 62 of the entrance section 60 is provided with a step 63, defining a rest for placing the resting faces 59 of the positioning shoulders 57. Placing the positioning shoulders 57 on the bottom end 62 of the entrance section 60 of the ground contact housing 45 limits the insertion of the ground contact 33 in the insertion direction I into the ground contact housing 45 and avoids pressing the ground contact 33 further than intended in the insertion direction I into the ground contact housing. This prevents an undesired deformation of the ground contact 33.

The anchoring plate 32 is connected with the proximal end of the positioning shoulders 57 facing against the insertion direction I. The anchoring plate 32 is principally arranged in a plane perpendicular to the insertion direction I and adapted such that it can be placed in the ground channel 42 of the connector housing 7 and extends from the ground channel 42 to the opening 46 of the ground contact housing 45. The anchoring plate 32 has at its narrow lateral sides 68, with respect to the longitudinal direction L of the anchoring plate 32, anchoring recesses 64 adapted for receiving and engaging with counter-elements 65 of the connector housing 7. Inside these anchoring recesses 64, fixation elements 65, **65*a* of the connector housing can be placed for restricting movement of the anchoring plate 33 in the plane perpendicular to the insertion direction I. Thereby, the anchoring recesses 65 in conjunction with the anchoring elements 65, 65*a* provide strain relief elements for compensating any strain applied to the ground contact 33 when pulling at the ground wire 31**.

In the mounted state, the ground terminal 29 mounted at the connector housing 7 with its ground contact 33 arranged in the ground contact housing 45, whereby the pin 54 is placed in the recess 55 at the bottom 56 of the ground contact housing 45, the resting faces 59 of the positioning shoulders 57 are placed on the steps 63 at the bottom end 62 of the entrance section 60, and the anchoring recesses 64 engage with anchoring elements 65, **65*a* of the connector housing 7. The cover 21, when connected to the connector housing 7, secures the ground terminal 29 at the ground contact 33 against removal from the attachment element 43 against the insertion direction I. To achieve this, the cover 21 is provided with a pressing part 66 that aligns with and presses in the insertion direction I onto the anchoring plate 32 in the fully assembled state of the electrical connector 1** according to the embodiment shown in the Figures of the present application.

The invention claimed is:

1. Electrical connector for a plug-in connection, comprising a connector housing having a mating part defining a receiving section adapted for receiving a mating section of a counter-connector, at least two contact terminals that are placed in contact apertures in the receiving section, each contact terminal comprising a contact element for receiving a contact pin of the counter-connector, and a ground assembly comprising a ground contact having a contacting portion adapted for being electrically connected with a grounding element of the counter-connector and an attachment element for mounting the ground contact wherein the ground contact assembly is arranged outside the receiving section with the contacting portion extending at least section-wise into the receiving section.

2. Electrical connector according to claim 1, wherein the attachment element is arranged at an outer surface of the mating part.

3. Electrical connector according to claim 1, wherein the attachment element comprises a ground contact housing shielding the ground contact against the outside.

4. Electrical connector according to claim 3, wherein the ground contact housing is formed integrally with the connector housing.

5. Electrical connector according to claim 1, wherein the ground contact is mounted with positive locking at the attachment element.

6. Electrical connector according to claim 5, wherein a cover secures the ground contact against removal from the attachment element.

7. Electrical connector according to claim 1, wherein the mating part comprises a window forming a passage into the receiving section.

8. Electrical connector according to claim 7, wherein the window forms a passage from the ground contact housing to the receiving section.

9. Electrical connector according to claim 7, wherein the window is designed as a slot.

10. Electrical connector according to claim 1, wherein the ground contact is substantially arranged along an insertion direction (I), in which the electrical connector is plugged with the counter-connector.

11. Electrical connector according to claim 1, wherein at least one positioning element for securing the ground contact against displacement out of a pre-determined mounted position.

12. Electrical connector according to claim 11, wherein the positioning element is arranged at the distal end of the ground contact.

13. Electrical connector according to claim 11, wherein the ground contact comprises stiffening regions providing an improved resistance to deformation.

14. Electrical connector according to claim 1, wherein the ground contact has at least section-wise a U-shaped cross-section.

* * * * *